US009273485B2

(12) United States Patent
Goode

(10) Patent No.: US 9,273,485 B2
(45) Date of Patent: Mar. 1, 2016

(54) SYSTEM AND DEVICE FOR CONTAINING A DUMPSTER

(71) Applicant: Steven Craig Goode, Raleigh, NC (US)

(72) Inventor: Steven Craig Goode, Raleigh, NC (US)

( * ) Notice: Subject to any disclaimer, the term of this patent is extended or adjusted under 35 U.S.C. 154(b) by 235 days.

(21) Appl. No.: 13/865,253

(22) Filed: Apr. 18, 2013

(65) Prior Publication Data

US 2013/0277633 A1 Oct. 24, 2013

Related U.S. Application Data

(60) Provisional application No. 61/640,046, filed on Apr. 30, 2012, provisional application No. 61/625,844, filed on Apr. 18, 2012.

(51) Int. Cl.

| | |
|---|---|
| ***E04H 17/18*** | (2006.01) |
| ***E06B 5/00*** | (2006.01) |
| ***B65F 1/14*** | (2006.01) |
| ***E04H 17/16*** | (2006.01) |

(52) U.S. Cl.

CPC ..... *E04H 17/18* (2013.01); *B65F 1/1426* (2013.01); *E04H 17/16* (2013.01); *E06B 5/00* (2013.01)

(58) Field of Classification Search

CPC ..... E04H 17/18; E04H 17/16; B65F 1/1426; E04B 1/34321; E06B 5/00; E06B 5/02

USPC ..... 256/19, 25, 26, 73; 49/397

See application file for complete search history.

(56) References Cited

U.S. PATENT DOCUMENTS

| | | | | |
|---|---|---|---|---|
| 3,217,913 | A | 11/1965 | Aldredge | |
| 3,504,813 | A | 4/1970 | Weir | |
| 3,669,485 | A | 6/1972 | Stihler | |
| 3,924,913 | A * | 12/1975 | Cooper | 312/258 |
| 3,969,788 | A | 7/1976 | McCullough | |
| 3,969,846 | A | 7/1976 | Scott | |
| 4,357,000 | A | 11/1982 | Tisbo et al. | |
| 4,373,849 | A | 2/1983 | Robinson | |
| 4,550,849 | A | 11/1985 | Adsit | |
| 4,702,036 | A | 10/1987 | Johnson | |
| 4,726,616 | A | 2/1988 | Schmidt | |
| 4,913,301 | A | 4/1990 | Pickler | |
| 4,930,753 | A | 6/1990 | Alvyn | |
| 5,183,180 | A | 2/1993 | Hawkins et al. | |
| 5,330,071 | A | 7/1994 | Parker | |
| 5,382,111 | A * | 1/1995 | Melashenko et al. | 403/329 |

(Continued)

FOREIGN PATENT DOCUMENTS

| | | |
|---|---|---|
| EP | 2096049 A1 | 9/2009 |
| RU | 69044 U1 | 12/2007 |

(Continued)

OTHER PUBLICATIONS

PCT Search Report from corresponding PCT application No. PCT/US2013/037156.

(Continued)

*Primary Examiner* — Joshua Kennedy

(74) *Attorney, Agent, or Firm* — James G. Passé; Passé Intellectual Property, LLC

(57) ABSTRACT

A dumpster enclosure having replaceable panels and a front gate designed with sockets positioned to allow access to a dumpster lift arm opening for removal of the dumpster front enclosure by a garbage truck without exiting the garbage truck.

16 Claims, 9 Drawing Sheets

(56) References Cited

U.S. PATENT DOCUMENTS

| | | | | |
|---|---|---|---|---|
| 5,494,261 | A | 2/1996 | Gandara | |
| 5,609,327 | A | 3/1997 | Amidon | |
| 5,967,361 | A | 10/1999 | Darnell | |
| 5,975,660 | A * | 11/1999 | Tisbo et al. | 312/263 |
| 6,296,132 | B1 | 10/2001 | Pickler | |
| 6,702,135 | B2 | 3/2004 | Pickler | |
| 6,796,087 | B1 * | 9/2004 | Greene | 52/32 |
| 6,802,158 | B1 | 10/2004 | Greene | |
| 6,978,576 | B2 * | 12/2005 | Shirk | 49/57 |
| 7,083,060 | B2 | 8/2006 | Pickler | |
| 7,234,275 | B1 * | 6/2007 | Haggy et al. | 52/71 |
| 7,237,689 | B2 | 7/2007 | Maggio, Sr. et al. | |
| D549,917 | S * | 8/2007 | Kassigkeit | D34/10 |
| 8,141,921 | B2 | 3/2012 | Apps et al. | |
| 2007/0175108 | A1 * | 8/2007 | Stein et al. | 52/79.5 |
| 2011/0114910 | A1 * | 5/2011 | Stuckel | 256/24 |
| 2015/0069312 | A1 * | 3/2015 | Cooper et al. | 256/26 |

FOREIGN PATENT DOCUMENTS

| | | | |
|---|---|---|---|
| SU | 1283347 | A1 | 1/1987 |
| SU | 1576436 | A1 | 7/1990 |
| SU | 1703579 | A1 | 1/1992 |

OTHER PUBLICATIONS

Wikipedia, Dumpster, http://en.wikipedia.org/wiki/Dumpster.

Dumpster Enclosures-Fences Unlimited, http://fencesunlimited.net/commercial-fencing/dumster-enclosures/.

* cited by examiner

SYSTEM AND DEVICE FOR CONTAINING A DUMPSTER

This application claims priority of U.S. provisional application No. 61/640,046 filed on Apr. 30, 2012 and U.S. provisional application No. 61/625,844 filed on Apr. 18, 2012. All applications are included herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to dumpster enclosures and systems using them. In particular the present invention relates to dumpsters with an enclosure having a front door.

2. Description of Related Art

Dumpsters have been widely used for decades in commercial waste settings where large accumulation of trash occurs. These receptacles commonly are designed to be utilized with a fork or other lifting device on the front of a truck for engaging and lifting the dumpster and emptying the contents into the truck. Because the dumpster gets fairly messy looking and the area around it fairly unsightly, it is common to build an enclosure for one or more dumpsters in attempt to keep the area more appealing looking by merely hiding the waste receptacle dumpster enclosure inside a neater fenced in area.

Dumpster enclosures are usually a three-sided rectangular structure with some sort of gate in the front fourth side to enclose the dumpsters or in some case other type trash receptacles. The industry tends to build each dumpster enclosure one at a time designed for the particular area, number and size of dumpsters and the like. The walls and gates for these dumpster enclosures are made from chain link, metal, wood and are typically made of heavy duty materials to withstand the severe abuse they sustain from garbage trucks their drivers and the people using the dumpster. They tend to become damaged quickly; including dents, rust, have faded paint and the like. The maintenance costs tend to be substantial to keep the enclosure attractive and pleasant looking.

When gates are used on the enclosure there is a substantial cost to the trash collector to utilize his truck and collect the trash from the dumpster. The truck with a lift and dump apparatus is typically driven up to the gates of the dumpster enclosure with the front loading lift device facing the doors and hence the dumpster as well. The driver comes to a complete stop and gets out of the vehicle and opens the gate to obtain access to the dumpster. Then the driver returns to the truck drives up to the dumpster to couple the dumpster to the lift on the truck. The dumpster is lifted and dumps its contents in the body of the truck. Once the dumpster is returned to the ground the driver has to close the doors to the enclosure by getting out of the truck before returning to the truck and leaving. Driver spends two-thirds of his time or more dealing with the enclosure doors. The another way of looking at it is if there were no doors the trash collector could visit 3 times as many locations in the same time as he visits one.

BRIEF SUMMARY OF THE INVENTION

The present invention relates to the discovery that a dumpster container enclosure that significantly reduces the costs associated with the collection of emptying a dumpster container used by a commercial or other user. The enclosure allows the trash collector to drive up to the enclosure of the invention with a dumpster garbage truck with the front loading lift facing the dumpster doors, couple the dumpster with the front loading lift without opening the gate or getting out of the truck. Then the driver can back up the truck to move the dumpster outside of the present invention enclosure and dump the garbage in the truck in the normal way. The reverse process returns the dumpster to its place. The process cuts the time used by the driver to open and close the doors to visit more locations and thus be more effective with time. The enclosure of the present invention is also easy to assemble and repair and thus represents a cost saving to the user/purchaser.

Accordingly in one embodiment, there is a modular enclosure for a dumpster having an arm on each of a left side and a right side comprising:

a) a plurality of metal pole hinge pin anchors arranged in the shape of the enclosure;

b) a plurality of flat panels mounted by their vertical edges between a pair of metal poles, each panel having a plurality of vertically aligned sockets along the vertical edges that are offset from the set on an opposite panel side such that when two planes are placed side-by-side the vertically aligned sockets of adjacent panels are interlaced and mounted on the metal poles;

c) zero or more corner panels mounted by their vertical edges between a pair of metal poles, each panel having a plurality of vertically aligned sockets along the vertical edges that are offset from the set on an opposite panel side such that when two planes are placed side-by-side the vertically aligned sockets of adjacent panels are interlaced and mounted on the metal poles;

d) A front gate mounted between two metal poles on a front side of the enclosure.

In yet another embodiment, there is a front gate for the front of a dumpster enclosure having a dumpster therein, where in the dumpster has an arm with a lift opening on each of a left side and right side arms for lifting by a front loading garbage truck prongs and a front of the dumpster each facing the front of the enclosure the front gate comprising:

a pair of doors, each door having a socket along an inside vertical edge of the door wherein the sockets are aligned with each of the dumpster arms such that the door does not block the arm lift opening.

DETAILED DESCRIPTION OF THE INVENTION

Figure 1:
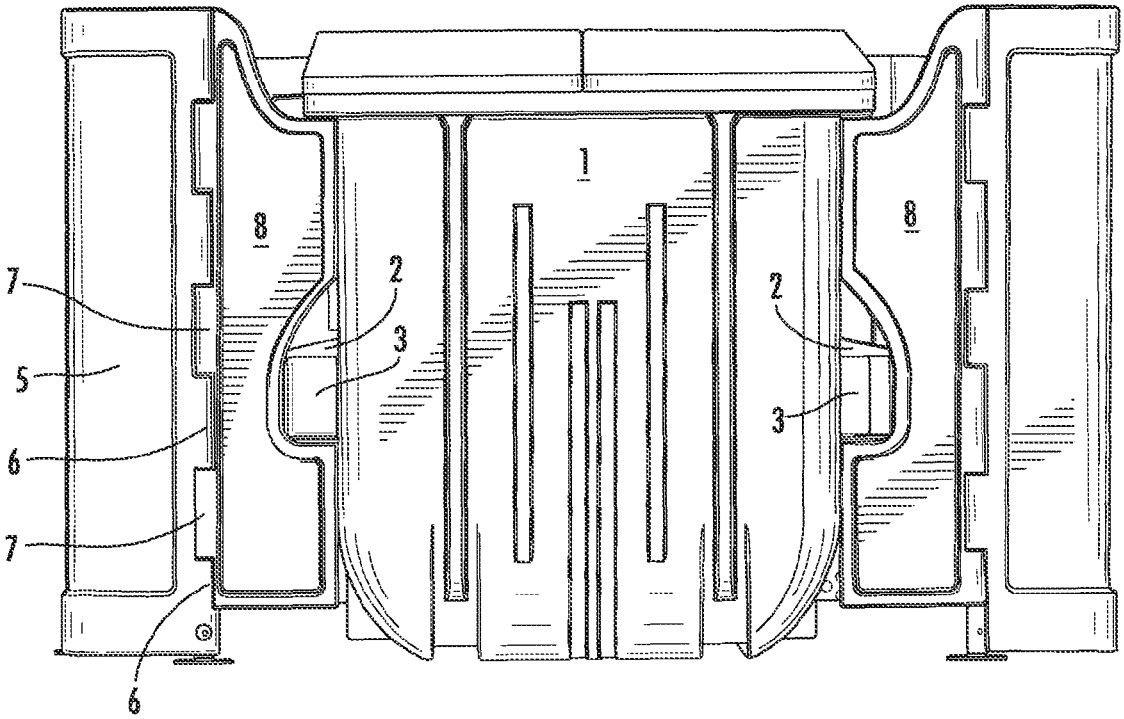
FIG. 1 is a front view of short café doors on an enclosure containing a dumpster.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, "dumpster" means a very large capacity trash receptacle (also called a garbage bin) having a bottom side, four side walls, and one or more lids connected by a hinge to cover the top. Dumpsters typically have a capacity in excess of 95 gallons, and are made of metal or heavy-duty plastic. Dumpsters are emptied by front-loading garbage trucks. These trucks have large prongs or arms on the front which are aligned and inserted into arms (or slots) openings on the left and right side of the dumpster as one faces the dumpster and the dumpster faces forward. Hydraulics then lift the prongs and the dumpster, eventually flipping the dumpster upside-down and emptying its contents into the truck's hopper (storage compartment).

As used herein the term "modular enclosure" refers to an enclosure for surrounding a dumpster such as one having an arm on each of a left side and a right side. Dumpster enclosures are in general well known and are typically rectangular and large enough to fit the dumpster typically with room for an individual to move around inside the enclosure. One skilled in the art can size the dumpster accordingly for the present invention. Modular refers to enclosure consisting of metal poles sitting or embedded in the ground, asphalt or the like to which panels are mounted to by sliding them onto the poles or clipping them in place on the poles they each span the distance between the poles. A damaged panel can easily be replace and the enclosure easily constructed by delivering the modular parts and snapping them in place. Further description of an example enclosure can be seen in the provisional applications to this application incorporated herein by reference as noted above.

As used herein the term "metal pole hinge pin anchors" refers to standard metal poles such as used for chain link fencing which as described above can placed in the ground at selected intervals (i.e. the width of the panels corners and doors) for mounting the panels doors etc. they act as both hing pins and as anchors for the enclosure to bind the enclosure to the floor base such as cement asphalt or the like One skilled in the art can easily select the length of the pole and placement based on panel width in view of the disclosure herein.

As used herein the term "flat panels" refers to panels that are made of a rigid polymer such as polypropylene and the like. However any rigid polymer that can be safely utilized outdoors can be selected. The panels can be colored have designs in them and the like. The length and width may be of any size but in one embodiment a longitudinal side of five or six feet will be sufficiently high to adequately conceal most commonly used dumpsters as of the date of this application. Each panel has a plurality of vertically aligned sockets along both longitudinal sides with a centrally disposed hole in each socket.

As used herein the term "vertically aligned sockets" refers to sockets in the left and right vertical sides of panels (flat, corner and door) which can attach to the metal poles and which interlock adjacent panels. This embodiment can be clearly seen in the drawings. The number size and exact shape are not limited by the particular figures and any socket positioned to interlock with adjacent panels is contemplated within the present invention. The vertically aligned sockets along one longitudinal side are offset from those along an opposite longitudinal side such that when two panels are placed side-by side in an abutting relationship with each other the vertically aligned sockets of adjacent panels will interlace with each other and the centrally disposed poles will align vertically to receive a steel post to bind the abutting panels together. This process is repeated with additional abutting panels until the entire set of walls of the enclosure are completed. Corner pieces can also be utilized but in one embodiment regular panels can be utilized at the corners without corner pieces As used herein "corner panels" refers to panels which have a bend e.g. 90 degrees, to form the shape of the enclosure. In the figures there are 4 corner pieces though in one embodiment no corner pieces are utilized as desired and panels are just aligned differently.

As used herein a "front gate" refers to a front pair of doors on the enclosure. The doors can partially cover the front with the dumpster covering the rest of the front and acting as part of the front gate, the doors can cover the entire front of the enclosure or cover the entire front or be of a size as desired. In one embodiment there will be two café style doors, i.e. two hinged matching doors which can swing either in or out and optionally have a bias to the neutral or closed position. Other biases could also be included including an open position bias. There will be sockets in the doors positioned such that the socket openings allow direct access to the dumpster arm openings. This will allow a garbage truck to use the lifting arms to pass through the front door into the dumpster arm openings lift the dumpster and as the truck moves forward with the dumpster the front doors will open by being pushed by the dumpster movement against it.

As used herein "café doors" refers to a pair of swing doors that cover at least a portion of the front entrance to the dumpster enclosure. They have openings, slots sockets that allow the prongs of the garbage truck to access the arm openings through the closed café doors. The doors can be biased to swing inwards as well as outwards as desired so that when the garbage truck approaches the enclosure to insert the prongs in the arm openings to move the dumpster the doors will swing outwards to clear any interference that may exist between the dumpster container sides and the swinging doors. Upon returning the dumpster to the enclosures the doors may swing inward to clear interference as it is placed back on the floor base. The doors can be full size doors or as in the figures partial size café doors. Where café doors, in one embodiment, are the front of the dumpster can act as part of the front gate.

As used herein the term "decorative inserts" refers to panels which fit into the flat panels for the purpose of adding decorative patterns to the walls of the dumpster enclosure. Examples such as in the figures could be replacing with any artistic design and can be attached by means know in the art. The inserts could be of any material but could be plastic metal or the like as desired.

The present invention dumpster enclosure reduces the costs associated with the process of emptying a dumpster by using a truck with prong lifts. The enclosures café doors with socket openings allows the trash collector to drive up to a designated side of the enclosure with the café doors with the front loading lift facing the dumpster doors. The driver couples the dumpster through the slot openings in the café door, pulls the dumpster through the closed doors by backing up the truck to move the dumpster outside the enclosure and allow the driver to empty the dumpster without getting out of the truck. The controls may then be reversed to return the dumpster to the enclosure again decouple the prongs and drive off without leaving the truck.

Now referring to the figures, FIG. 1 is a front view of two short café doors on an enclosure containing a dumpster. Dumpster 1 has dumpster arms 2 with dumpster arm lift openings 3. The openings are for lifting with the prongs of a garbage truck designed to lift such dumpsters. The corner panels 5 are shown with their sockets 6 intermeshing with the sockets 7 of café doors 8.

Figure 2:
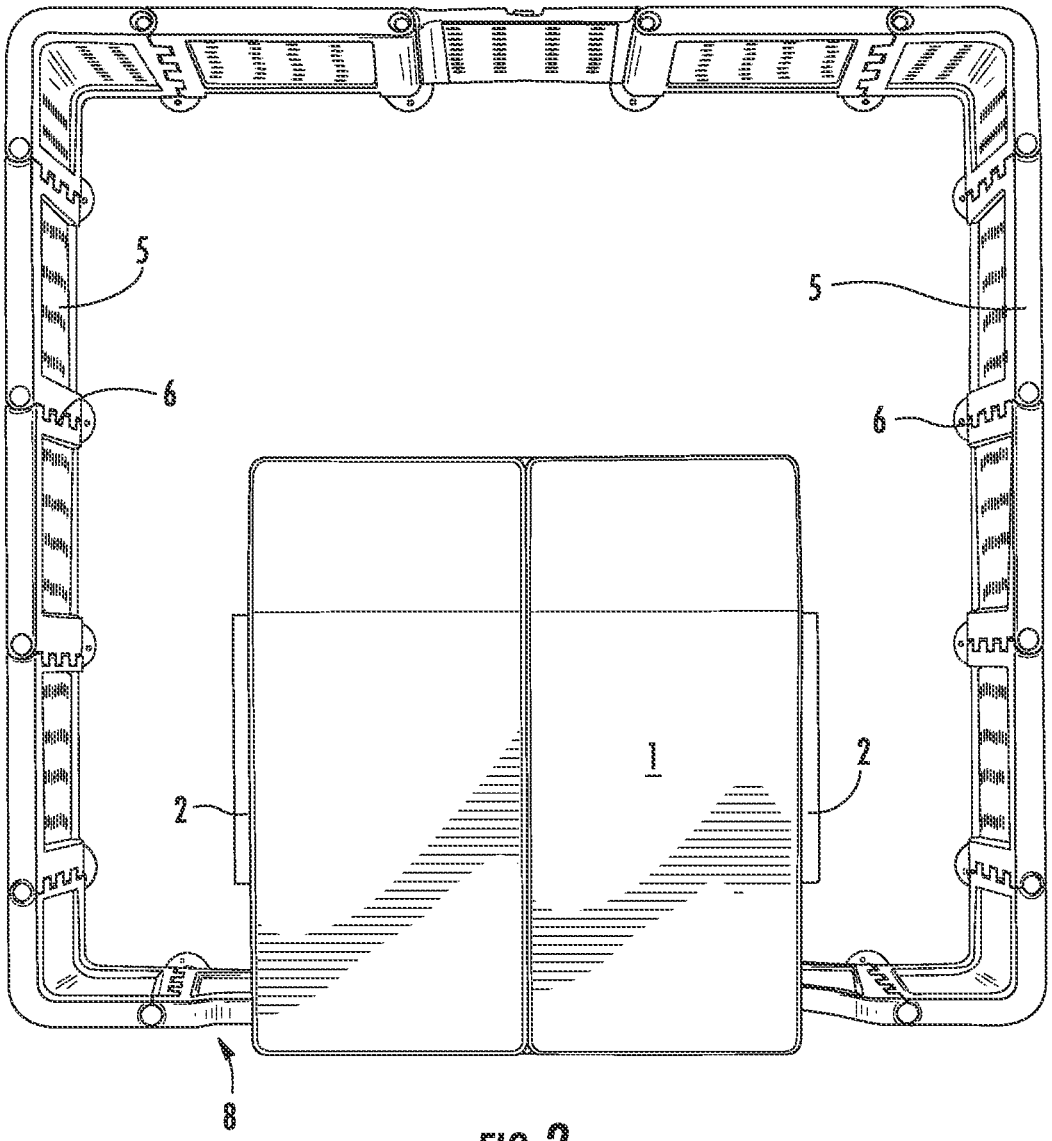
FIG. 2 is a top view of an enclosure with a dumpster.

FIG. 2 is a top view of an enclosure with a dumpster. This view shows the top of dumpster 1 and top of café doors 8. In addition it shows the tops of panels 5 and tops of metal poles 6.

Figure 3:
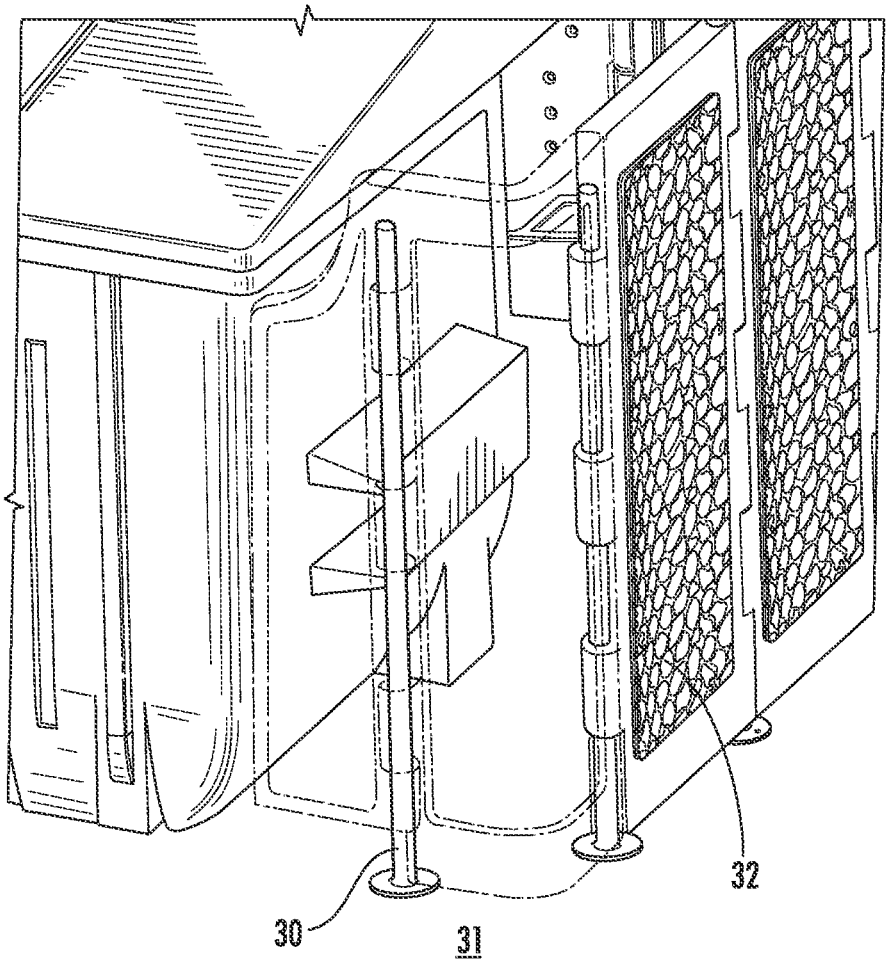
FIG. 3 shows a corner of the enclosure with the metal poles.
Figure 4:
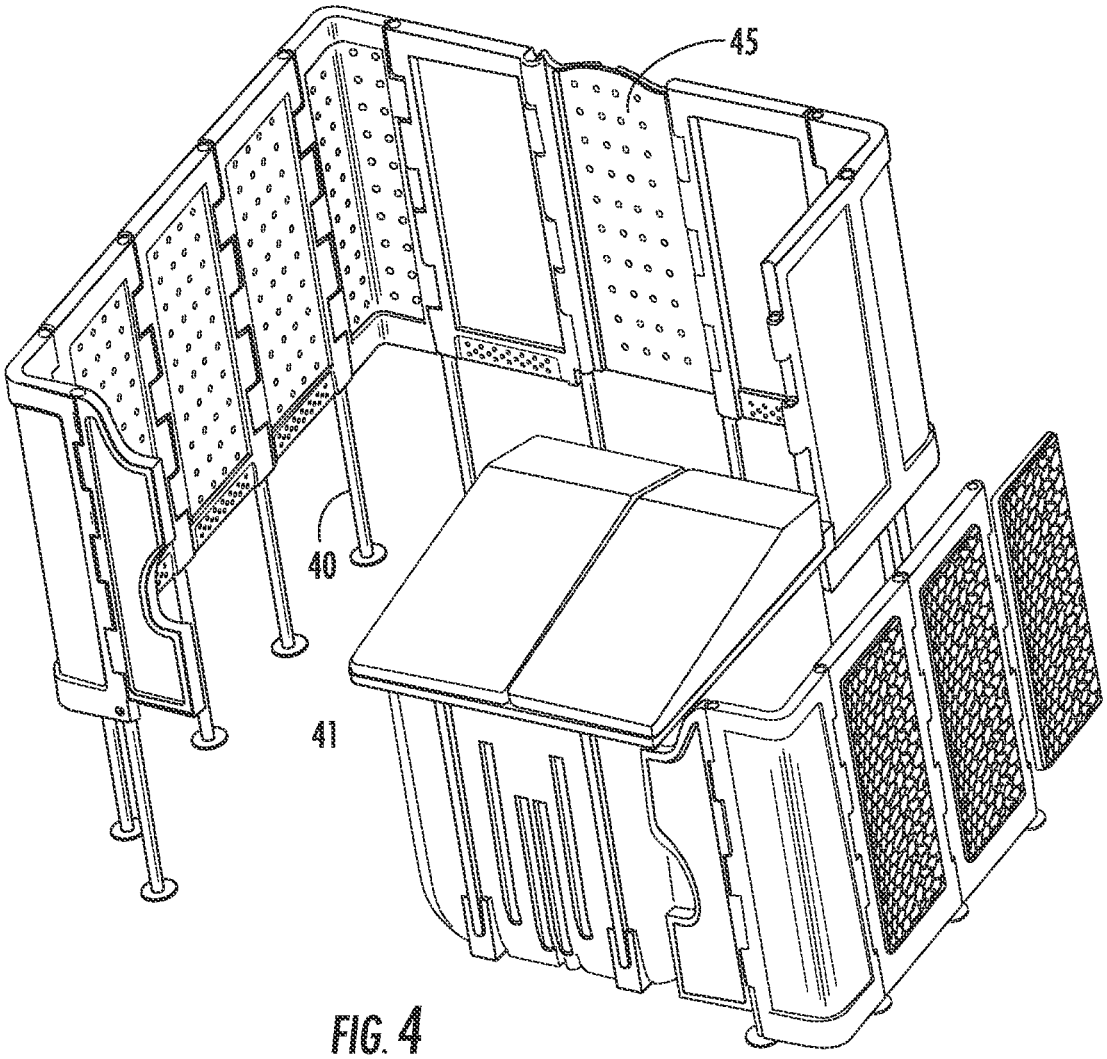
FIG. 4 depicts the modular design of the enclosure.

FIG. 3 shows a corner of the enclosure with the metal poles. Metal poles 30 are made of steel in this embodiment and are securely attached to ground 31 to bond panels 32 together and provide pivot points FIG. 4 depicts the modular design of the enclosure. In this view metal poles 40 which are mounted in the ground 41 are shown. The panels 42 are sliding down poles 40 to be in place. This door shows optional door panel 45 which can be place like any other panel as desired. The modular design allows plat compact shipping of all the components of an enclosure. It also allows each addition or replacement of panels and allows for size customization.

Figure 5:
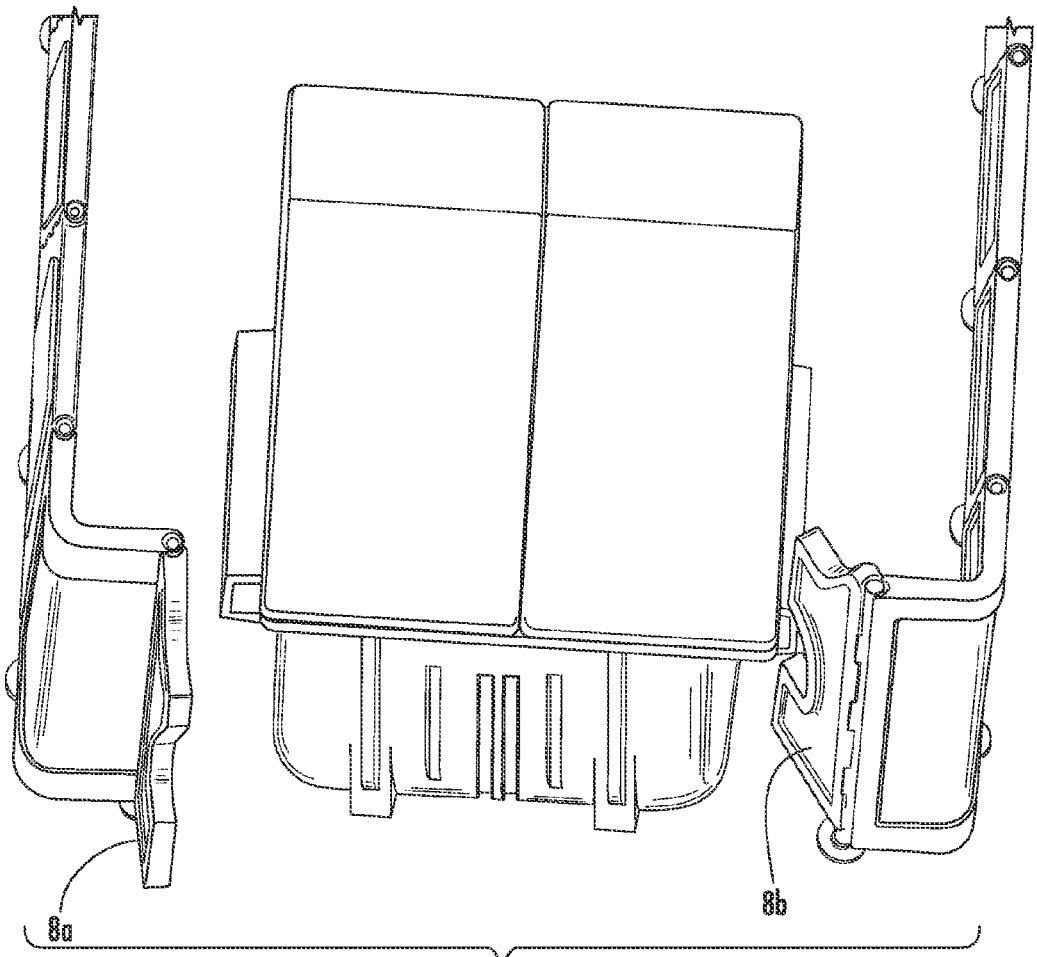
FIG. 5 depicts a top front perspective of the enclosure.

FIG. 5 depicts a top front perspective of the enclosure. In this view, café doors 8*a* and 8*b* are shown swung forward and backwards respectively to provide easy access.

Figure 6:
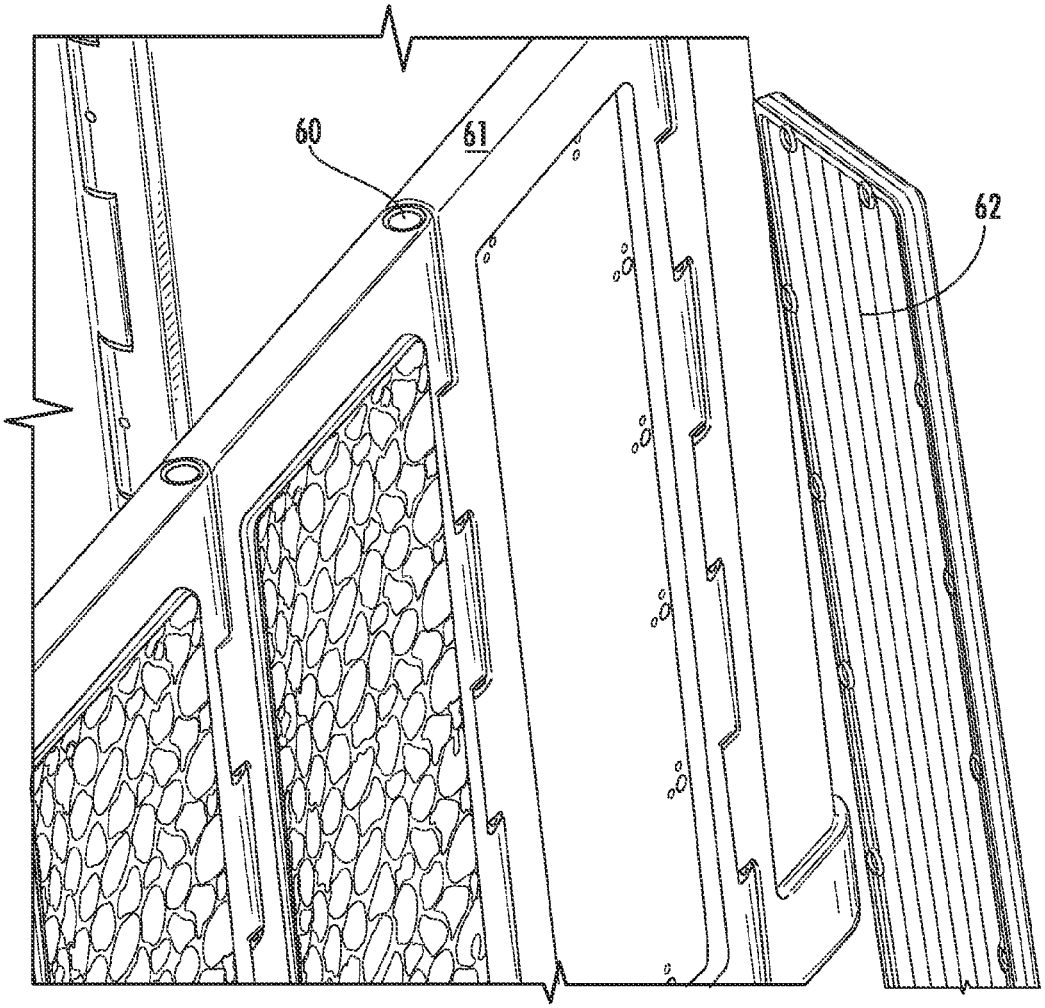
FIG. 6 is a perspective view of optional decorative panel inserts.

FIG. 6 is a perspective view of optional decorative panel inserts. Shown in this perspective are metal poles 60 and panels 61. Decorative panel 62 is placed on the panel facing the outside to provide a variety of decorative looks. They can be molded or the like in contrasting or complementary patterns and colors. In this embodiment they are molded with a plurality of depressions on the backside of the decorative panel which are intended to snap into raised knobs molded onto the outer periphery of the panel segments.

Figure 7A:
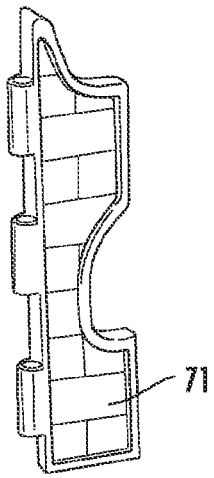
FIGS. 7*a* through 7*d* are perspective views of individual pieces of the modular design dumpster enclosure.
Figure 7B:
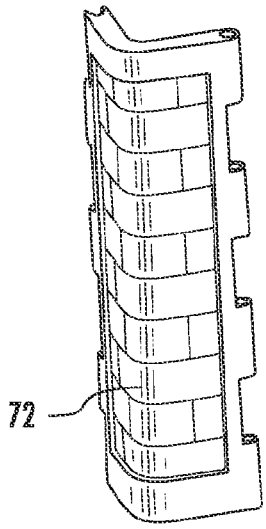

FIGS. 7*a* through 7*d* are perspective views of individual pieces of the modular design dumpster enclosure. FIG. 7*a* is a mini café door 71 showing a brick decorative pattern which can be molded into the door or a decorative panel used to decorate the door as described above. FIG. 7*b* is a corner panel 72 with a brick decorative pattern.

Figure 7C:
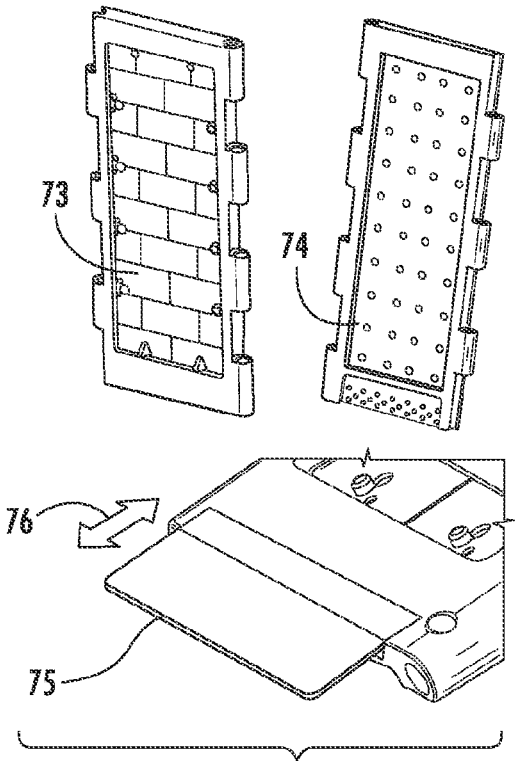
Figure 7D:
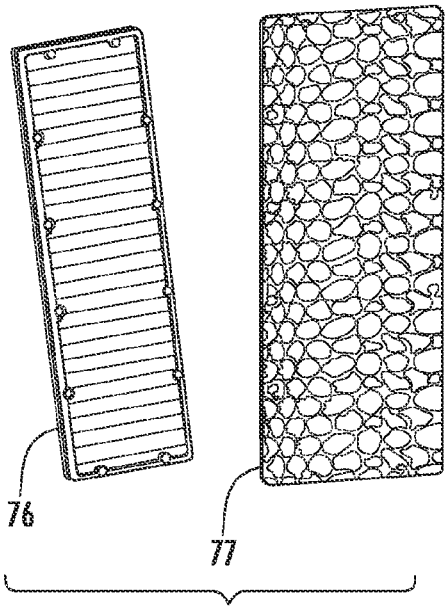

FIG. 7*c* shows the front 73 and back 74 or a panel wherein the decorative panel 75 slips into a slot in the panel and slides in and out of the panel in the directions of arrows 76. FIG. 7*d* depicts decorative panels 76 and 77 which just show the versatility of design using replacement decorative panels.

Figure 8:
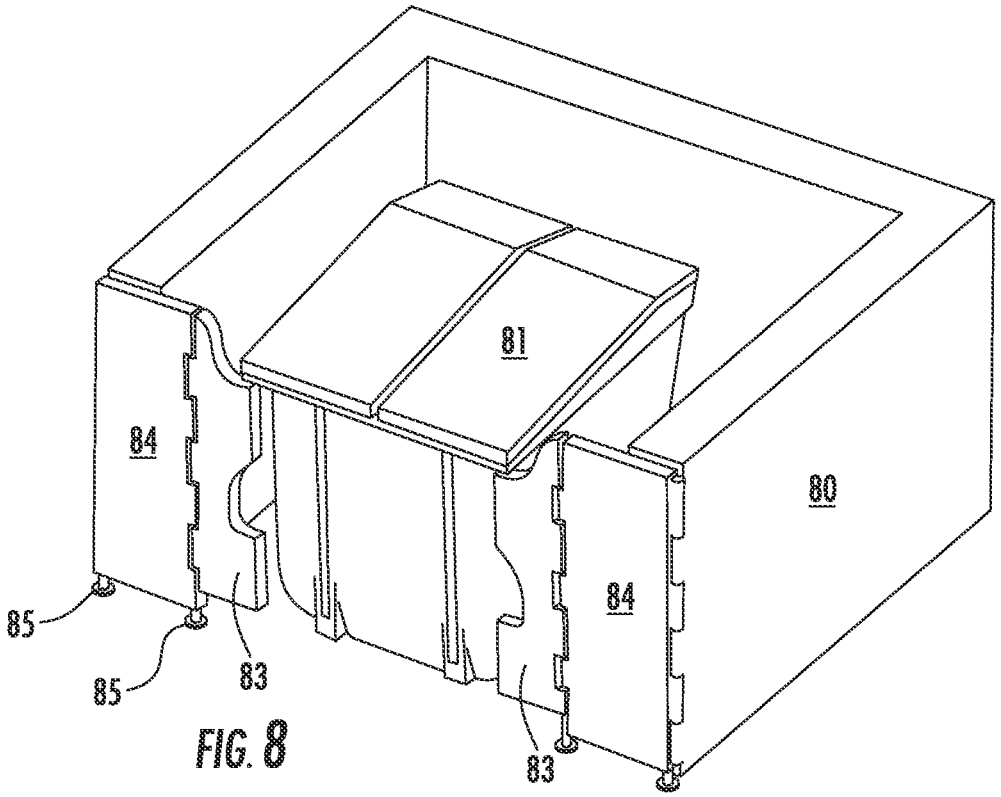
FIG. 8 is a perspective view of the café doors of the present invention used with a conventional cement or cinderblock enclosure.
Figure 9:
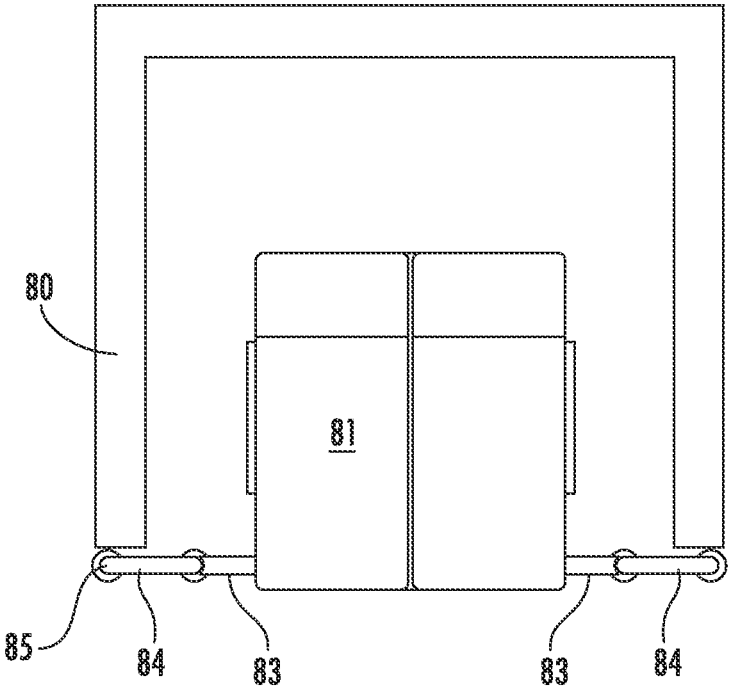
FIG. 9 is a top view of the perspective shown in FIG. 8.

FIG. 8 is a perspective view of the café doors of the present invention used with a conventional cement or cinderblock enclosure. In this view cement enclosure 80 has dumpster 81 on the inside. Café doors 83 show that such doors can be mounted onto this type of enclosure as well. In this embodiment two panels 84 on metal poles 85 are further utilized to mount café doors 83. FIG. 9 is a top view of the perspective shown in FIG. 8.

Figure 10:
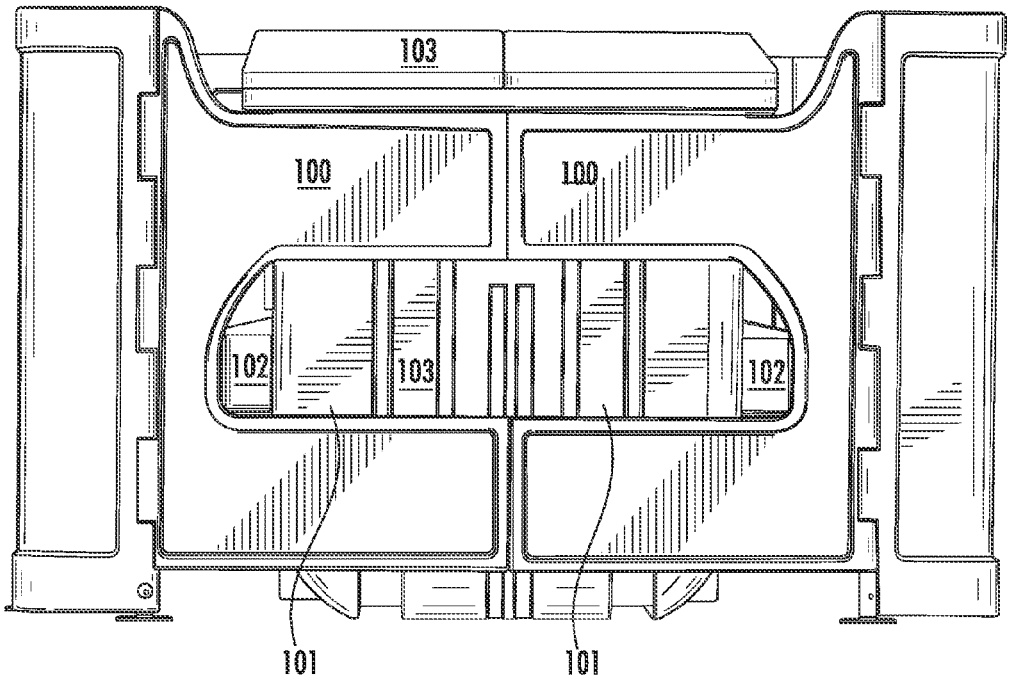
FIG. 10 is a view as in FIG. 1 except full size café doors are utilized instead of the mini-doors.

FIG. 10 is a view as in FIG. 1 except full size café doors are utilized instead of the mini-doors. In this view doors 100 meet at their longitudinal edge. The socket 101 allows for the prongs of the garbage truck to be inserted into arm openings 102 and the dumpster removed without getting out of the truck. It is clear that any width doors can be utilized as long as the socket 101 extends to the longitudinal edge of the door that faces the corresponding longitudinal edge of the opposing café door 101.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A modular enclosure for having a dumpster therein, the dumpster facing a front of the enclosure, and having left and right lift arm openings for lifting by the prongs of a front loading garbage truck, the enclosure comprising:

a) a plurality of pole hinge pin anchors arranged about a perimeter of the enclosure;

b) a plurality of flat panels, each mounted by their vertical edges between a pair of poles, each flat panel having a set of vertically aligned sockets along the each vertical edge such that the vertically aligned sockets are offset from a set of vertically aligned sockets on an adjacent flat panel such that when two adjacent panels are placed side-by-side the vertically aligned sockets of the adjacent flat panels are interlaced and mounted on the poles; and c) a front gate having a pair of doors mounted on the front side of the enclosure, the pair of doors having corresponding vertical edges that face each other and openings therein that extend from the respective vertical edges that allow the prongs of the garbage truck to access the left and right lift arm openings on the dumpster when the pair of doors is closed.

2. The enclosure according to claim 1 wherein the doors are café doors.

3. The enclosure according to claim 1 wherein each door has a hinge attaching to the enclosure on its outside edge.

4. The enclosure according to claim 1 wherein at least one of the flat panels has decorative inserts.

5. The enclosure according to claim 1 wherein a front of the dumpster comprises a portion of the front gate.

6. The enclosure according to claim 1 wherein each of the doors inside vertical edges meet in front of the front of the dumpster.

7. The enclosure according to claim 1 wherein the doors are biased to a closed position.

8. The enclosure according to claim 1 which further comprises corner panels.

9. A front gate for a front of a dumpster enclosure having a dumpster therein, wherein the dumpster has an arm with a lift opening on each of a left side and right side, the arms for lifting by front loading garbage truck prongs and a front of the dumpster each facing the front of the enclosure, the front gate comprising:

a pair of doors, each door having a socket extending from an inside vertical edge of the door; wherein the sockets are capable of being aligned with each of the dumpster arms such that the door does not block the arm lift opening to allow the prongs of the garbage truck to access the left and right lift arm openings on the dumpster when the pair of doors is closed.

10. The front gate according to claim 9 where in the doors are cafe doors.

11. The front gate according to claim 9 wherein each door has a hinge attaching to the enclosure by its outside edge.

12. The front gate according to claim 9 wherein the doors inside vertical edge are separated by a width of the dumpster.

13. The front gate according to claim 12 wherein a front of the dumpster comprises a portion of the front gate.

14. The front gate according to claim 9 wherein each of the doors inside vertical edges meet in front of the front of the dumpster.

15. The front gate according to claim 9 wherein the doors are biased to a closed position.

16. A modular enclosure for having a dumpster therein, the dumpster facing a front of the enclosure and having left and right lift arm openings for lifting by the prongs of a front loading garbage truck, the enclosure comprising:

a) an enclosure for surrounding the dumpster;

b) a front gate pair of doors mounted on the front side of the enclosure, the pair of doors having corresponding vertical edges that face each other and openings therein that extend from the respective vertical edges that allow the prongs of the garbage truck to access the left and right lift arm openings on the dumpster when the pair of doors is closed.

* * * * *